US008459496B2

(12) United States Patent
Simson et al.

(10) Patent No.: US 8,459,496 B2
(45) **Date of Patent: *Jun. 11, 2013**

(54) PNEUMATIC VENDING MACHINE

(75) Inventors: Anton K. Simson, Escondido, CA (US); Henri J. A. Charmasson, San Diego, CA (US)

(73) Assignee: Anton K. Simson, San Diego, CA (US)

( * ) Notice: Subject to any disclaimer, the term of this patent is extended or adjusted under 35 U.S.C. 154(b) by 616 days.

This patent is subject to a terminal disclaimer.

(21) Appl. No.: 11/886,983

(22) PCT Filed: Mar. 24, 2006

(86) PCT No.: PCT/US2006/010869

§ 371 (c)(1),
(2), (4) Date: Sep. 21, 2007

(87) PCT Pub. No.: WO2006/102607

PCT Pub. Date: Sep. 28, 2006

(65) Prior Publication Data

US 2009/0057333 A1 Mar. 5, 2009

Related U.S. Application Data

(63) Continuation-in-part of application No. 11/088,625, filed on Mar. 24, 2005, now Pat. No. 7,367,472.

(60) Provisional application No. 60/556,427, filed on Mar. 24, 2004.

(51) Int. Cl.
*B65H 3/44* (2006.01)

(52) U.S. Cl.
USPC ..... 221/130; 221/131; 221/226; 221/278; 221/124; 221/198; 221/197; 221/221; 221/224; 221/251; 221/258; 221/279; 221/287; 221/298; 221/299; 221/301; 221/75; 221/29; 221/54; 221/81; 221/88; 221/161

(58) Field of Classification Search
USPC ..... 700/236; 221/130, 131, 226, 278, 221/124, 198, 197, 224, 251, 258, 279, 287, 221/298, 299, 301, 75, 29, 54, 81, 88, 161
See application file for complete search history.

(56) References Cited

U.S. PATENT DOCUMENTS 3,130,865 A * 4/1964 Ono et al. ..... 221/226
3,254,794 A 6/1966 Meresz et al.

(Continued)

FOREIGN PATENT DOCUMENTS

GB 289503 4/1928
GB 2090821 7/1982

(Continued)

OTHER PUBLICATIONS

European Search Report from corresponding European Patent Application No. EP 06 73 9582, Date: Sep. 13, 2010.

*Primary Examiner* — Gene O. Crawford
*Assistant Examiner* — Rakesh Kumar
(74) *Attorney, Agent, or Firm* — Charmasson, Buchaca & Leach, LLP

(57) ABSTRACT

A machine particularly adapted for dispensing light items (19) packaged in symmetrical, frustum-shaped containers. The items are propelled through a tubular cartridge (3) by compressed air, and in the absence of any solid pushing, pulling or carrying device, then individually dispensed. A flow of compressed air generated by a blower (28) is s fed to the back of the cartridge. The items are dispensed under control of a toggling dual-gate mechanism (26, 27) at the front end of the cartridge. The dual-gate mechanism of a removable magazine (2) grouping a number of cartridges can be selectively addressed and activated by means of a solenoid-driven cross-bar assembly (38).

14 Claims, 5 Drawing Sheets

U.S. PATENT DOCUMENTS

| | | | | |
|---|---|---|---|---|
| 3,602,403 | A * | 8/1971 | Klem | 222/251 |
| 3,653,541 | A * | 4/1972 | Crum | 221/150 HC |
| 5,522,310 | A * | 6/1996 | Black et al. | 99/357 |
| 5,927,539 | A * | 7/1999 | Truitt et al. | 221/2 |
| 6,085,534 | A * | 7/2000 | Anthony | 62/231 |
| 6,834,775 | B1 * | 12/2004 | Collins | 221/124 |
| 7,367,472 | B2 * | 5/2008 | Simson et al. | 221/130 |
| 7,418,311 | B1 * | 8/2008 | Lagassey et al. | 700/236 |
| 2005/0115981 | A1 * | 6/2005 | Sands et al. | 221/150 R |

FOREIGN PATENT DOCUMENTS

| | | | |
|---|---|---|---|
| WO | 94/25942 | A1 | 11/1994 |
| WO | 2004/006195 | A2 | 1/2004 |

* cited by examiner

PNEUMATIC VENDING MACHINE

PRIOR APPLICATION

This is a 371 of International Patent Application Serial No. PCT/US2006/010869 which is a continuation-in-part of U.S. patent application Ser. No. 11/088,625, filed 2005 Mar. 24, now U.S. Pat. No. 7,367,472 issued 2008 May 6, which claims the benefit of U.S. Provisional Patent Application No. 60/556,427 filed 2004 Mar. 24.

FIELD OF THE INVENTION

This invention relates to machines for dispensing goods including automatic vending machines, and more specifically to machines for dispensing articles or substances packaged in symmetrical containers such as the ones commonly used in connection with individual servings of coffee, tea, sugar, shampoo, toothpaste, as well as medicines and cosmetics.

BACKGROUND

In the coffee service industry, individual doses of coffee, tea or chocolate are often offered in small containers that are configured to be readily inserted in a brewing machine. Boxes holding large quantities of the products are usually placed next to the brewing machines for the convenience of employees and customers. In most cases, this type of beverage service is provided and paid by the employer.

The system is subject to abuses. Unscrupulous employees may grab handfuls of containers for use at home. Unsupervised persons, such as maintenance and janitorial crews who frequent the premises during off hours may also be tempted to help themselves to undue quantities of goods.

There is a need to find a convenient solution to the uncontrolled presentation and dispensing of small packaged articles.

SUMMARY

The invention provides a simple, inexpensive, and efficient way to store, transport, display and dispense small packaged items under some form of paid or verifiable accounting to authorized or paying customers.

The preferred embodiment consists of a machine for selectively dispensing one out of a number of items stored in a removable magazine formed by a two dimensional stacking of horizontally aligned tubular cartridges. Each cartridge forms an internal channel whose cross-section is commensurate with the cross-section of the leading and largest portion of the kind of item it contains, such as the lid or brim of a frusto-conical cup. A pressurized fluid, preferably a flow of air generated by a blower or turbine, is applied to the back aperture of the channel in order to propel the items forwardly toward the frontal dispensing aperture where a toggling barrier mechanism can be momentarily activated to let the most forwardly positioned item escape, while the next item in line and every other item behind it are held back.

A crossbar actuator is used to selectively drive the barrier mechanism controlling the dispensing of the desired type of item. The dispensing of an item must be enabled either by the dialing of a personal identification code on a keypad, or by payment by way of currency, smartcard or a combination of both.

Some embodiments provide a machine, for selectively dispensing a plurality of items, which comprises: at least one tubular cartridge, said cartridge forming an elongated channel having a frontal dispensing aperture, a back-loading aperture, a cross-section commensurate with a maximal cross-section of one of said items and a given interior diameter; a source of pressurized fluid; conduit means for feeding said pressurized fluid to said back aperture; and a toggling mechanism alternately allowing dispensing of a first one of said items and holding back a second one of said items next in line behind said first one.

In some embodiments said mechanism comprises: a first barrier movable from a locking position across said frontal aperture to a releasing position clear of said channel; a second barrier movable from a clearing position clear of said channel to a retaining position across said frontal aperture; said first and second barriers being togglably linked to alternately move said second barrier to said retaining position when said first barrier is moved into said releasing position, and to said clearing position when said first barrier is moved into said locking position.

In some embodiments the machine further comprises means for moving said first barrier to said releasing position and said second barrier to said retaining position during a momentary period of time and for simultaneously applying said pressurized fluid to said dorsal aperture; whereby one of said items normally held by said first barrier is ejected through said frontal aperture while any other one of said items in said channel is held back by the return of said first barrier to the locking position.

Some embodiments provide the machine in combination with a plurality of symmetrical ones of said items each having a leading portion cross-section shaped and dimensioned to substantially fit the cross-section of said channel, and a trailing portion cross-section of lesser area than said leading portion cross-section.

In some embodiments the machine comprises: a plurality of said cartridges assembled into a magazine; and wherein said means for moving comprises means for selectively toggling the barrier of one of said cartridges.

In some embodiments said means for toggling comprise a cross-bar array.

In some embodiments said means for toggling further comprise a set of solenoids driving said array.

In some embodiments the machine further comprises: a plug having a cross-diameter substantially equal to the largest cross-diameter of said items, in a last position in each of said cartridges; and means for preventing ejection of said plug from said cartridge regardless of the position of said barriers.

In some embodiments said magazine is detachable from said machine.

In some embodiments said means for toggling comprise an electro-mechanical mechanism including at least one solenoid.

In some embodiments said mechanism further comprises: a shaft rotatively positioned adjacent said cartridge; and said first and second barriers project radially from said shaft at different angular positions and alternately penetrate said channel through apertures in said cartridge when said shaft is partially rotated back and forth.

In some embodiments said cartridge is in a substantially, axially horizontal position, and said items are propelled through said channel in the absence of any solid pushing, pulling or carrying device.

In some embodiments said plug comprises a disc made of flexible plastic, secured to the back of said plug and having a diameter slightly larger than the diameter of said channel, and short, peripheral, radial cuts.

In some embodiments said plug comprises a pad made of felt material, secured to the back of said plug and having a diameter slightly larger than the diameter of said channel.

DESCRIPTION OF THE EXEMPLARY EMBODIMENTS

Figure 3:
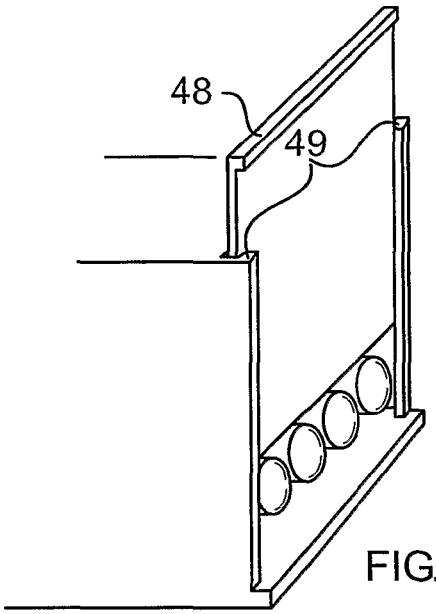
FIG. 3 is a partial rear perspective view.
Figure 1:
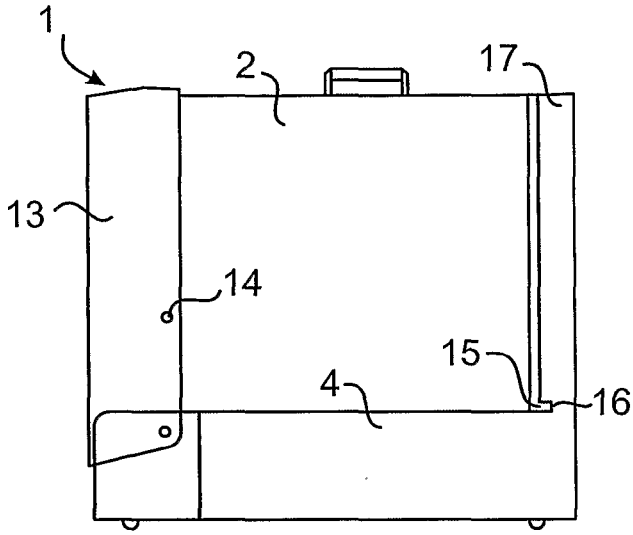
FIG. 1 is a side elevational view of a vending machine according to the invention.

Referring now to the drawing, there is shown a vending machine 1 particularly adapted to dispense a number of different items packaged in light containers made of paper or plastic. In this particular embodiment, the machine is intended to dispense individual servings of coffee or other beverages such as K-CUP brand coffee, tea and chocolate packages commercially available from the Keurig Brewers Company. The machine accommodates a removable magazine 2 that groups a series of cartridges 3 each holding a different type of product. The base 4 of the machine houses electromechanical and pneumatic mechanisms that control the dispensing of the goods off the cartridges. An electronic control unit 5 provides an interface with the user of the machine by way of an alpha-numeric readout 6, a smart card reader 7, an alpha-numeric keypad 8, a currency acceptor 9, and a series of control buttons 10. A dispensing pocket 11 for the goods is provided in the frontal portion of the base. The pocket is accessible by pushing a flap door 12. The front of the machine is sealed by a cover 13 whose transparent face permits viewing of the first item in each cartridge. In its closed position, the cover is locked by a couple of solenoid-control bolts 14. The magazine has a flange 15 in its lower back that interlocks with a commensurate groove 16 in the back panel 17. Once the magazine 2 is installed on the machine and the cover has been shut and locked, the magazine cannot be removed.

Figure 8:
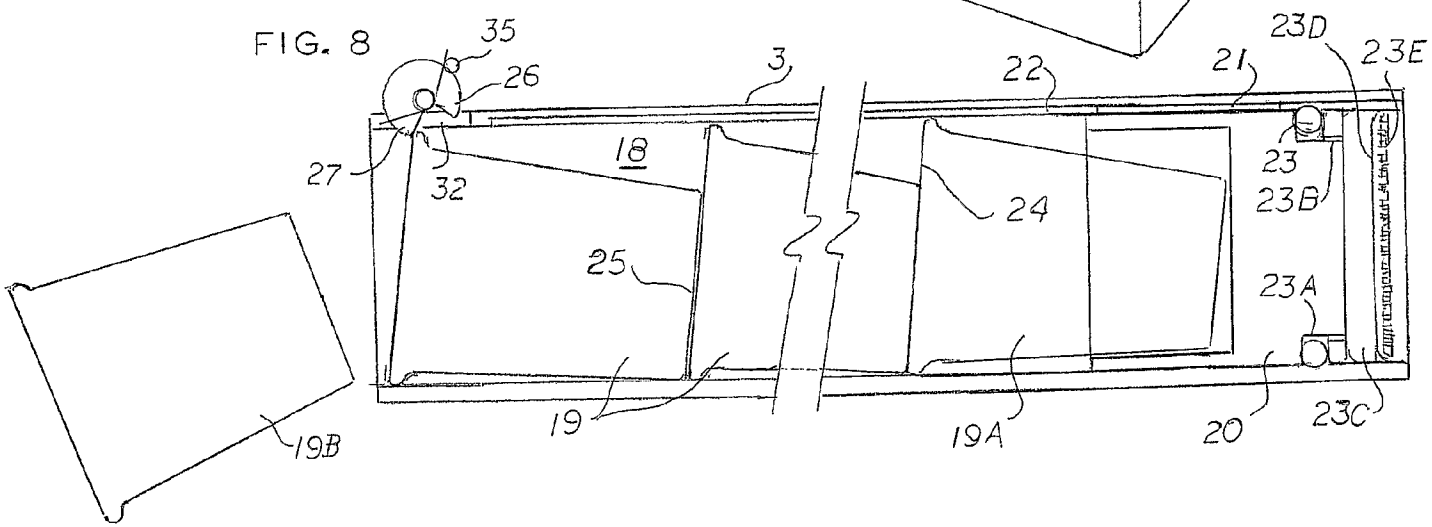
FIG. 8 is a cross-sectional view of a cartridge.
Figure 10:
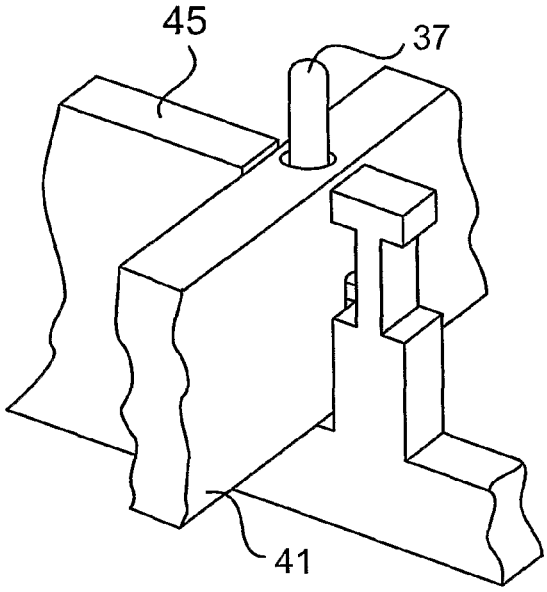
FIGS. 10 and 11 are perspective view of the crossbar engaging structure.

As more particularly illustrated in FIG. 8, each tubular cartridge 3 forms a channel 18 into which the symmetrical items 19 to be dispensed are lined one-behind-the-other followed by a plug 20 acting as a dummy item slidingly engaged in a last position behind all other items into the rear portion of the channel. The plug has an open front end allowing the last item 19A to penetrate into it, thus increasing the capacity of the cartridge. The plug has a key 21 projecting radially along the length of its upper wall into a groove 22 cut along the roof of the channel 18. The groove terminates short of the front aperture of the channel. Once the key reaches the end of the groove, the plug cannot be ejected out the front aperture of the channel as are the items 19. It should be noted that each item 19 has a leading portion 24 whose cross-section diameter is substantially commensurate with the inside diameter of the channel 18. The geometry of the item then tapers down to a trailing portion 25 of a lesser diameter. Near the front aperture of the channel, two pairs of toggling barriers 26, 27 can be alternately inserted through window apertures 31, 32 in an upper a portion of the channel in order to separately hold or release a single item at-a-time under the push of the plug 20. The plug is propelled forward down the channel by an influx of compressed air generated by a motor-driven blower 28 housed in the base 4 of the machine. The compressed air is distributed to all the cartridges through a manifold 29 formed in the back panel 17. An O-ring 23 caught in a circular groove 23A around the plug assures its air tightness. The groove is slightly deeper than the cross-section diameter of the O-ring, and communicate with the back of the plug via a set of pinholes 23B. When air pressure builds up in the back of the plug, it applies a radial force on the inside surface of the O-ring for better sealing action. Similarly, any air seeping around the rear end portion of the plug applies lateral pressure on the O-ring. That pressure tends to constrict the O-ring into forming a tighter seal. Alternately or in addition to the O-ring, a circular felt pad 23C is glued to the back of the plug 23. The diameter of the pad is slightly larger than the internal diameter of the channel 3 in order to crate a tighter peripheral air barrier. A sealing disc 23D also having a diameter slightly larger than the interior diameter of the channel 3, is secured to the back of the felt pad, to the back of the plug or inserted between the plug and the pad. The disk has a series of radial flares 23E that are formed by making short radial cuts around the disc periphery. The flares bent backward to create a resilient, tightly sweeping and sealing action against the interior of the channel. The disc is cut from a sheet of flexible plastic, preferably from a sheet of TEFLON® (PTFE, 75 microns thick commercially available from McMaster & Carr of Los Angeles, Calif.

Figure 7:
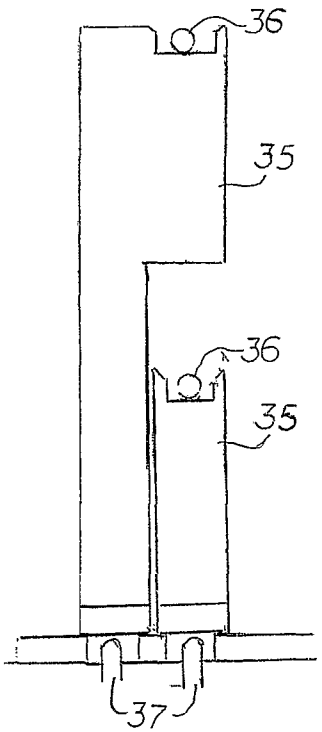
FIG. 7 is a side view of a pair of push-rods actuating the dispensing gate.
Figure 6:
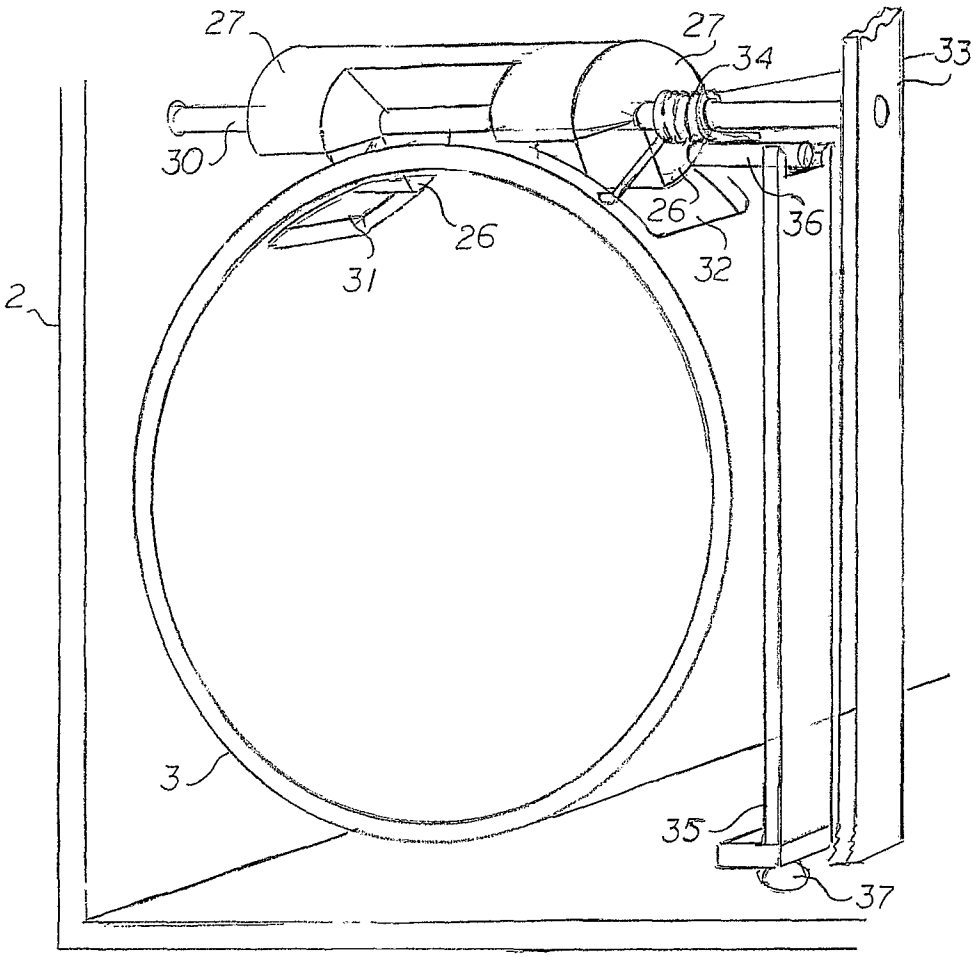
FIG. 6 is a partial perspective view of the toggling barrier mechanism.
Figure 9:
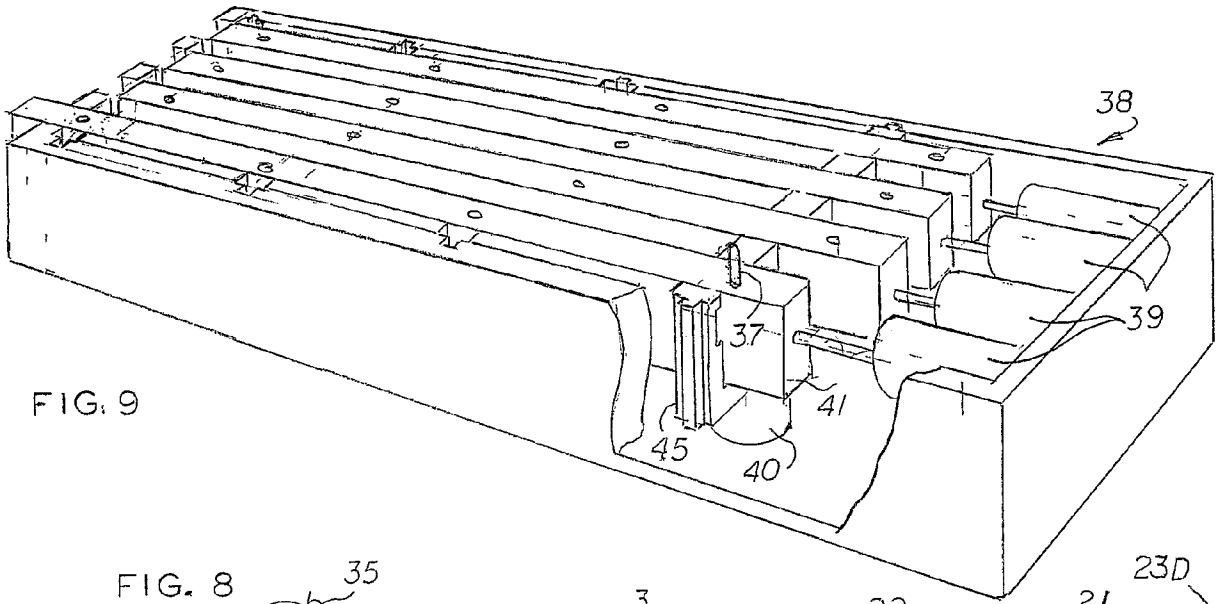
FIG. 9 is a perspective view of the crossbar actuator.

The toggling barrier mechanism is more particularly illustrated in FIGS. 6 and 7. The first and second pairs of barriers 26, 27 project radially from an horizontal axle 30 mounted adjacent to the cartridge 3 between vertical rails 33, or between a rail and a side wall of the magazine 2. Each barrier can penetrate into a small arc section of the cartridge channel through a pair window apertures 31, 32 cut through the wall of the cartridge. A number of push-rods 35 can be laid side-by-side to control the operation of superimposed cartridges as shown in FIG. 7. The rods are allowed to travel up and down within the guiding rail 33. Each rod acts upon a rocking lever 36 associated with the barriers, causing them to partially rotate back and forth around the axle 30 whereby the barriers alternately move in and out of the cartridge through the window apertures 31, 32.

When in the down position, the first or lower barrier 26 is held in the retaining position illustrated in FIG. 6, while the second or upper barrier 27 is held in a clearing position. When the push rod 30 is momentarily moved upwardly, the lower barrier is placed in a releasing position clear of the channel, and the upper barrier 27 is placed into a retaining position shown in FIG. 8. The rim of the first item in line moves between the two barriers. When the barriers return to their rest positions, that first item is ejected while the next item in line moves down the channel a short distance until it is retained by the return of the lower barrier 26 to the locking position, ready for the next dispensing maneuver. Each push-rod is urged downwardly by a coil spring 34 engaged over the axle 30, and wound between the rocking lever 36 and the wall of the cartridge 3. The push-rods are selectively lifted by push pins 37 rising from an actuator assembly 38 in the base of the machine, and passing through bores in the floor of the magazine.

Figure 11:
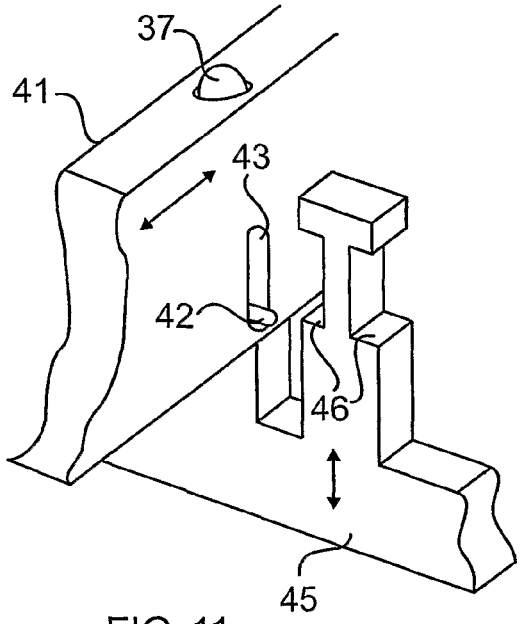
Figure 12:
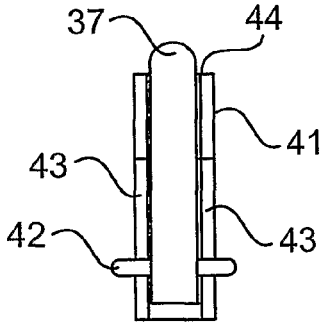
FIG. 12 is a cross-sectional view of a push pin.

As more specifically shown in FIGS. 9-12, the actuator assembly 38 comprises a cross-bar array driven by two sets of solenoids. Each in the first sets of solenoids 39 controls one row of cartridge in the magazine. Each of the second set of solenoids 40 controls one of the columns of cartridges. The selection of a particular row of cartridges is determined by the position of a row bar 41. Each row bar houses a series of push pins 37 which can be displaced upwardly by acting on a transversal pin 42 riding in a pair of slots 43 cut in the row bar through the walls of the well 44 housing the push pin. When the row bar 41 is pushed inwardly by it solenoid, the push pin 37 and its cross-pin 43 line up with a column bar 45. As the column bar is pushed upwardly by its solenoid 40, the transversal pin 42 becomes engaged by a cut 46 in the column bar on either side of the row bar, and, as the column bar is lifted, the push pin 37 is raised to lift a push-rod and actuate the corresponding toggling barrier in one of the cartridges. If the row bar is not engaged, as illustrated in FIG. 11, the lifting of the column bar misses the transversal pin, and the push pin remains in its well.

In a machine with a small magazine, one solenoid could be advantageously assigned to each toggling plate lieu of the crossbar actuator assembly 38.

Figure 2:
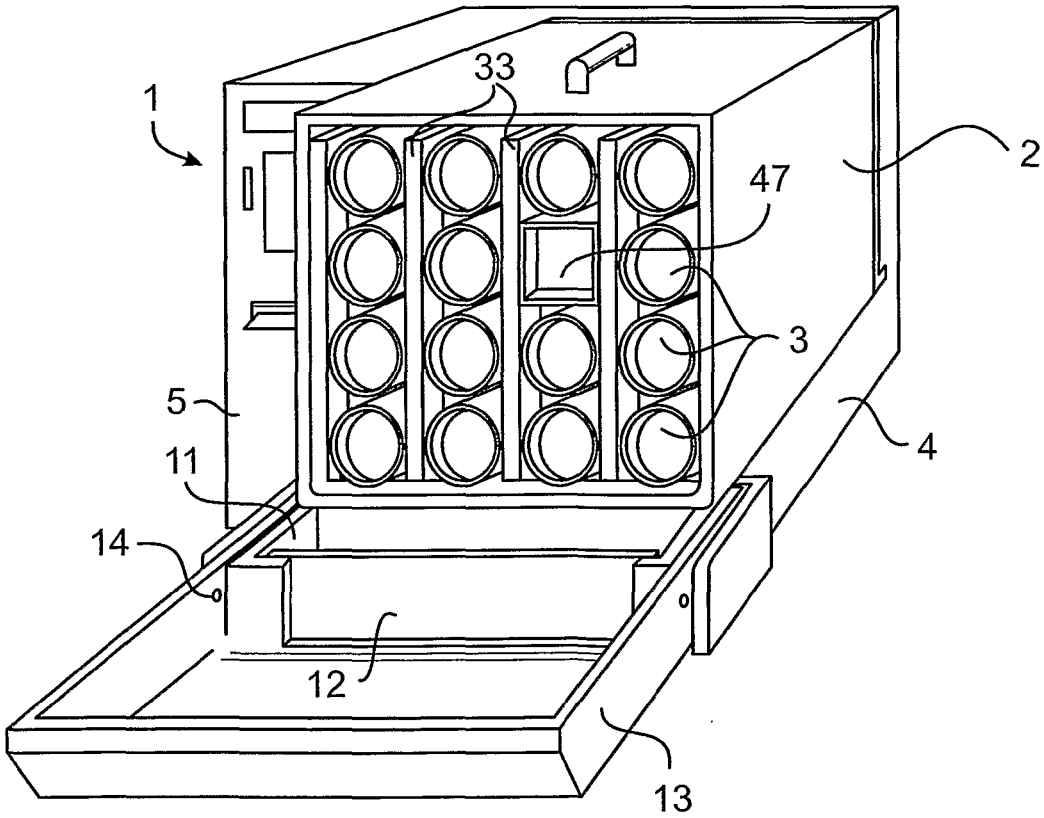
FIG. 2 is a front perspective view thereof with the cover in the open position.
Figure 4:
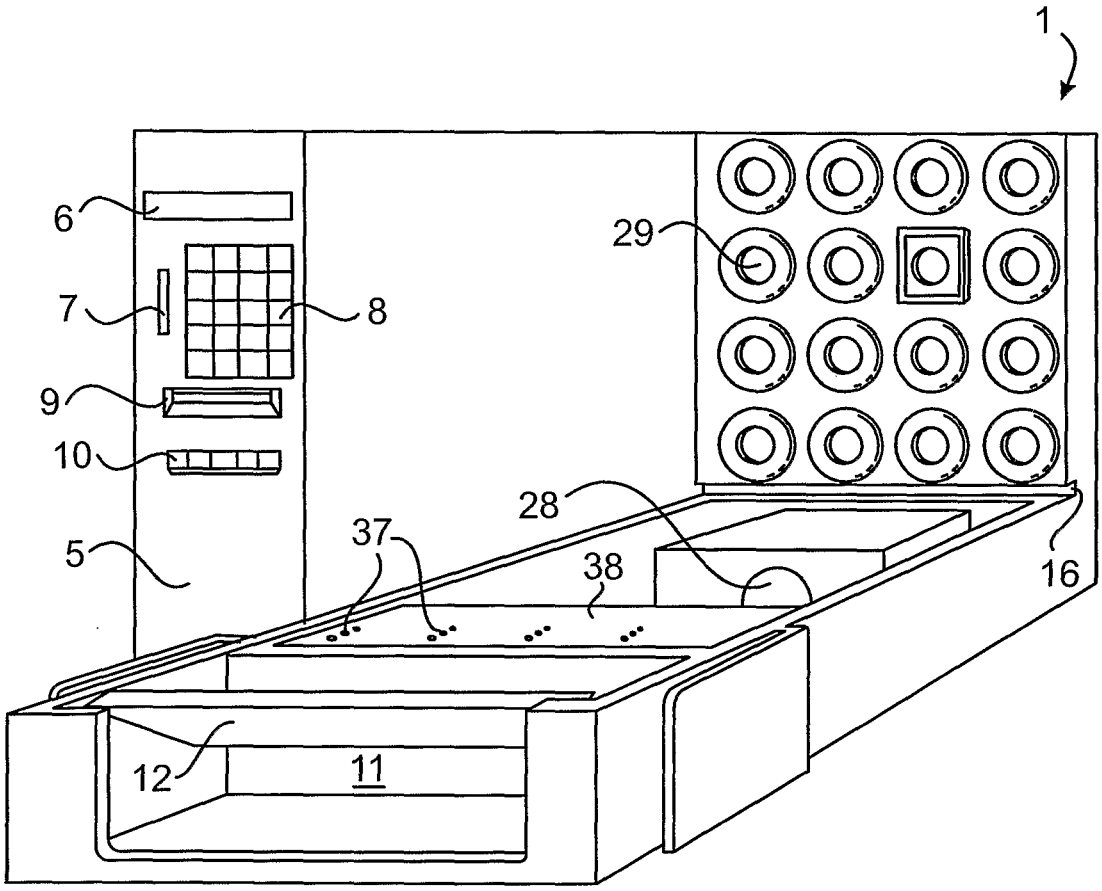
FIG. 4 is a front perspective view of the machine with the magazine and cover removed.
Figure 5:
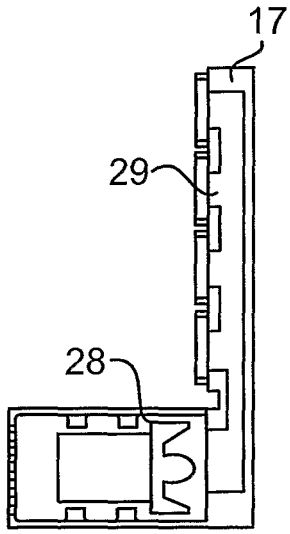
FIG. 5 is a cross-sectional view of the rear portion of the machine.

While the preferred embodiment of the invention has been limited to a four-by-four array of cartridges, it must be understood that much larger magazine can be used with corresponding larger actuator array. The cartridges can be shaped to accommodate a variety of packages not necessarily of a circular geometry. For instance, the quadrangular cartridge 47 illustrated in FIG. 2 could accommodate cubic or oblong rectangular containers of tooth paste, chewing gum, cookies or candies. The spacing between the first and second barriers may have to be adjusted to accommodate the full length of each item in the case where, for instance, shape of package is not frusto-conical or frusto-pyramidal. Bottles and some types of jars can be easily handled by limiting the spacing between the barriers 26, 27 to the thickness of their caps.

During transport and storage of the magazine, the back can be closed and secured by a backplate 48 riding, guillotine-style, in a pair of grooves 49 in the lateral walls of the magazine.

The electronic control unit allows for selective dispensing of a type of item in one of the cartridge by entry of a personal identification code on the keypad 8, or payment by way of a smartcard through the smartcard reader 7. The smartcard may be recharged by an amount of currency deposited through the currency acceptor 9. Accordingly an employer or operator of the machine can allow free access to the goods by authorized persons by assigning to each one of them a confidential identification code, or by providing the individuals with smartcards pre-charged with a monthly amount of cash credit usable on the machine. Full or partial payment can optionally be required using the combination of the currency acceptor and smartcard.

While the exemplary embodiments of the invention have been described, modifications can be made and other embodiments may be devised without departing from the spirit of the invention and the scope of the appended claims.

The invention claimed is:

1. A machine, for selectively dispensing a plurality of items, which comprises:

at least one tubular cartridge, said cartridge forming an elongated channel having a frontal dispensing aperture, a back-loading aperture, a cross-section commensurate with a maximal cross-section of one of said items and a given interior diameter;

a source of pressurized fluid;

conduits feeding said pressurized fluid into said tubular cartridge through said back aperture to propel said items toward said dispensing aperture; and a toggling mechanism alternately allowing dispensing of a first one of said items and holding back a second one of said items next in line behind said first one;

wherein said mechanism comprises:

a first barrier movable from a locking position across said frontal aperture to a releasing position clear of said channel;

a second barrier movable from a clearing position clear of said channel to a retaining position across said frontal aperture;

said first and second barriers being togglably linked to alternately move said second barrier to said retaining position when said first barrier is moved into said releasing position, and to said clearing position when said first barrier is moved into said locking position.

2. The machine of claim 1 which further comprises means for moving said first barrier to said releasing position and said second barrier to said retaining position during a momentary period of time and for simultaneously applying said pressurized fluid to said back-loading aperture;

whereby one of said items normally held by said first barrier is ejected through said frontal aperture while any other one of said items in said channel is held back by the return of said first barrier to the locking position.

3. The machine of claim 2 in combination with a plurality of symmetrical ones of said items each having a leading portion cross-section shaped and dimensioned to substantially fit the cross-section of said channel, and a trailing portion cross-section of lesser area than said leading portion cross-section.

4. The machine of claim 1, wherein said mechanism further comprises:

a shaft rotatively positioned adjacent said cartridge; and said first and second barriers project radially from said shaft at different angular positions and alternately penetrate said channel through apertures in said cartridge when said shaft is partially rotated back and forth.

5. The machine of claim 2, which comprises:

a plurality of said cartridge assembled into a magazine; and wherein said means for moving comprises means for selectively toggling the barrier of one of said plurality of said cartridge.

6. The machine of claim 5, wherein said means for toggling comprise an electro-mechanical mechanism including at least one solenoid.

7. The machine of claim 5 which further comprises:

a plug having a cross-diameter substantially equal to the largest cross-diameter of said items, in a last position in each of said cartridges; and means for preventing ejection of said plug from said cartridge regardless of the position of said barriers.

8. The machine of claim 5, wherein said magazine is detachable from said machine.

9. The machine of claim 7, wherein said plug comprises a disc made of flexible plastic, secured to the back of said plug and having a diameter slightly larger than the diameter of said channel, and short, peripheral, radial cuts.

10. The machine of claim 7, wherein said plug comprises a pad made of felt material, secured to the back of said plug and having a diameter slightly larger than the diameter of said channel.

11. A machine, for selectively dispensing a plurality of items, which comprises:

at least one tubular cartridge and a plurality of said items held therein, said cartridge forming an elongated channel having a frontal dispensing aperture, a back-loading aperture, a cross-section commensurate with a maximal cross-section of one of said items and a given interior diameter;

a source of pressurized fluid;

conduits feeding said pressurized fluid into said tubular cartridge through said back-loading aperture and causing said fluid to propel said items forwardly in a first direction toward said dispensing aperture and to eject said items forwardly in said first direction through said dispensing aperture; and a momentarily activated mechanism at said dispensing aperture letting the most forwardly positioned of said items escape forwardly in said first direction while allowing the remaining ones of said items to move in said cartridge, and holding back the remaining ones of said items from moving forwardly after said most forwardly positioned of said items has been ejected.

12. The machine of claim 11, wherein said cartridge is in a substantially, axially horizontal position, and said items are propelled through said channel and ejected by said pressurized fluid.

13. A machine, for selectively dispensing a plurality of items, which comprises:

at least one tubular cartridge, said cartridge forming an elongated channel having a frontal dispensing aperture, a back-loading aperture, a cross-section commensurate with a maximal cross-section of one of said items and a given interior diameter;

a source of pressurized fluid;

conduit means for feeding said pressurized fluid to said back aperture; and a toggling mechanism alternately allowing dispensing of a first one of said items and holding back a second one of said items next in line behind said first one;

wherein said mechanism comprises:

a first barrier movable from a locking position across said frontal aperture to a releasing position clear of said channel;

a second barrier movable from a clearing position clear of said channel to a retaining position across said frontal aperture;

said first and second barriers being togglably linked to alternately move said second barrier to said retaining position when said first barrier is moved into said releasing position, and to said clearing position when said first barrier is moved into said locking position;

a plurality of said cartridges assembled into a magazine; and wherein said means for moving comprises means for selectively toggling the barrier of one of said cartridges; and wherein said means for toggling comprise a cross-bar array.

14. The machine of claim 13, wherein said means for toggling further comprise a set of solenoids driving said array.

* * * * *